US005829956A

United States Patent [19]

Chen et al.

[11] Patent Number: 5,829,956

[45] Date of Patent: Nov. 3, 1998

[54] FAN BLADE ASSEMBLY

[76] Inventors: Yung Chen, 3 Larkspur La., Clarendon Hills, Ill. 60514; Manuel Almanza, 3905 W. 56th St., Chicago, Ill. 60629

[21] Appl. No.: 837,805

[22] Filed: Apr. 22, 1997

[51] Int. Cl.[6] ..... F01D 5/26

[52] U.S. Cl. ..... 416/196 A; 416/194; 416/244 R; 416/175; 416/201 R

[58] Field of Search ..... 416/194, 195, 416/196 A, 196 R, 244 R, 175, 203, 198 R, 200 R, 201 R, DIG. 5

[56] References Cited

U.S. PATENT DOCUMENTS

| | | | |
|---|---|---|---|
| D. 142,260 | 5/1945 | Lee | 416/193 A |
| D. 309,944 | 8/1990 | Chiu . | |
| D. 312,124 | 11/1990 | Coup et al. . | |
| D. 329,089 | 9/1992 | Coup et al. . | |
| D. 336,512 | 6/1993 | Cunning . | |
| D. 337,819 | 7/1993 | Cunning . | |
| D. 345,011 | 3/1994 | O'Grady . | |
| 1,021,822 | 4/1912 | Broussouse | 416/91 |
| 1,062,258 | 5/1913 | Schlotter . | |
| 2,100,994 | 11/1937 | Cohen . | |
| 2,154,313 | 4/1939 | McMahan . | |
| 2,407,858 | 9/1946 | Whitefield . | |
| 2,554,602 | 5/1951 | Sutton . | |
| 2,616,511 | 11/1952 | Perrott | 416/93 A |
| 2,620,126 | 12/1952 | Lyne . | |
| 2,620,721 | 12/1952 | Krauss . | |
| 2,652,974 | 9/1953 | Fettal . | |
| 2,697,589 | 12/1954 | Davey | 416/196 A |
| 2,787,207 | 4/1957 | Moore . | |
| 2,805,820 | 9/1957 | Evarts . | |
| 2,872,988 | 2/1959 | Koch et al. | 416/213 A |
| 3,173,478 | 3/1965 | Maycen . | |
| 3,421,428 | 1/1969 | Baumann et al. . | |
| 3,620,644 | 11/1971 | McLarty . | |
| 3,883,264 | 5/1975 | Rao . | |
| 3,986,794 | 10/1976 | Korn . | |
| 4,189,281 | 2/1980 | Katagiri et al. . | |
| 4,773,310 | 9/1988 | Corwin . | |
| 4,838,151 | 6/1989 | Shin-Chin . | |
| 4,872,399 | 10/1989 | Chaney . | |
| 5,096,382 | 3/1992 | Gratzer . | |
| 5,190,496 | 3/1993 | Shih-Chin . | |
| 5,334,091 | 8/1994 | Shih-Chin . | |
| 5,392,136 | 2/1995 | Wang . | |

OTHER PUBLICATIONS

REVCOR Engineering Bulletin.

TecAir, Inc. Sheet—Plastic Fan Blades Blower Wheels Hi–Efficiency Blowers.

*Primary Examiner*—Edward K. Look
*Assistant Examiner*—Richard Woo

[57] ABSTRACT

A fan blade assembly having a plurality of arranged about a central hub having an axis of rotation, the blades projecting from the hub radially outward from the axis of rotation. Each blade has a blade length, with a proximal end attached to the central hub and a distal end radially outward from the central hub. The assembly has at least one vane member with a plurality of vane segments, each vane segment joining a first blade with an adjacent second blade at a place along the blade length located radially inward from the distal end and radially outward from the proximal end of the blades. The assembly further having a plurality of recesses in the central hub adapted to receive the proximal end of blades of an adjacent blade assembly to permit stacking of like assemblies.

20 Claims, 4 Drawing Sheets

FAN BLADE ASSEMBLY

DESCRIPTION

TECHNICAL FIELD

The present invention relates to a propeller-type blade assembly. More specifically, the present invention relates to an improved propeller-type fan blade assembly for circulation of air flow.

BACKGROUND OF THE INVENTION

Propeller-type blade assemblies are designed to direct a medium, such as air or water, into a laminar flow in a direction transverse to the rotating blade assembly. One very common use for such a blade assembly is in the common window fan. Presently, window fans typically have a blade assembly made of molded plastic, having a plurality of blades projecting radially outward from a central hub or axis. The blades of the blade assembly may have any variation of shapes, with the most common design being a blade that has a curved angular cross section and a widened central portion. More sophisticated designs also have an overall twist along the length of the blade, and a decreased blade width at the end distal from the central hub or axis. This design is used to create a blade assembly which has a central region (i.e., radially inward from the distal ends of the blades) of the highest productivity of torque upon the medium. The blades also may have variations in the thickness of the blade material across the blade width. For example, to create a more rigid blade, the blade thickness may be greater in the central portion relative to the edges.

These types of blade assemblies are typically made of plastic, and are manufactured in a plastic molding process. A number of design limitations exist for these types of blade assemblies due to (1) difficulties in manufacturing; and (2) problematic aspects which naturally occur during use of the fan.

With regard to the manufacture of such blade assemblies, the molded plastic blade assemblies are subject to limitations in the thickness of the blades, and the molding process requires a substantial amount of cooling time prior to removing the product from the mold to prevent distortion of the thin plastic. Although it would be advantageous to make the blade assembly from thinner material, thereby reducing material cost, thinner blades are susceptible to distortion and inefficiencies during use. During the molding process, the blade assembly must be adequately cooled before removal from the mold in order to prevent or reduce the amount of distortion of the blades. This is especially true for blade assemblies made of plastic materials which exhibit a large amount of "shrinkage" and warpage when cooling from a mold temperature, such as polyethylene material.

Another problem with the manufacture of such blade assemblies is the difficulty in packing the blade assemblies together for storage and shipment. The primary problem with such blade assemblies is due to the fact that the central hubs of the blade assemblies do not inter-fit, because the lower blade assembly in a stack has front blade edges (at the proximal ends of the blades) that hit against the lower edge of the hub of the upper blade assembly, thereby preventing the hub of the lower assembly from fitting into that of the upper assembly.

With regard to the problematic aspects naturally occurring during use of the fan, blade assemblies are susceptible to a number of problems, including: (1) torsional vibration causing blade noise; (2) turbulent air causing loss of efficiency; (3) loss of efficiency due to air flow toward the distal ends of the blades; and (4) loss in the functional shape of the blade due to stress on the blade during prolonged use, sometimes referred to as "creep" of the blade.

The blades of this type of blade assembly typically have a shape designed to provide optimal torque of air flow. More specifically, the blades are designed to have a curved angle shape in cross-section, and a twisted shape along the blade length. This design, along with a widening of the blade relative to the distal ends of the blade, provides a specified area of the peak air flow, typically in a central region along the length of the blade. This central region of the blade experiences the highest level of axial load from the air medium to direct the air flow toward a laminar flow and, consequently, is subject to distortion. To minimize distortion of the blade and preserve efficiency, the thickness of these types of blades must be sufficient to maintain its shape.

Another design-limiting problem due to turbulent air pressure is potential blade noise. The blades are subject to turbulent air pressure when in use, which causes a torsional vibration. The torsional vibration has a resonance frequency which, at a certain level, may be heard by the fan user as a noise. To reduce the amount of torsional vibration, the blade is preferably made of thicker material, or, in some cases, may be designed to receive a lighter axial load (i.e., a less productive blade design).

Another problem during use of such a fan blade assembly is the loss of efficiency of the blades due to flow of air down the blade length toward the distal ends of the blades. It is preferable to not have such air flow toward the distal end of the blade, but to have the air flowing in a laminar flow pattern transverse to the blade length, as is desirable. Further, when air flows toward the distal ends of the blades, there is a loss in optimal performance of the fan because the air travels away from the regions of the blade which are more efficient at forcing air toward the desired laminar flow pattern.

Another problem occurring during use of this type of fan blade is a loss in the functional shape of the blade due to stress on the blade during prolonged use, sometimes referred to as "creep" of the blade. Because the blade is subject to turbulent air causing pressure against the blade to distort the blade from its designed shape, such as the design with a curvature in cross-sectional view, prolonged use of the fan eventually leads to permanent distortion of the blade to decrease the blade angle or curvature, resulting in a significant loss in efficiency of the fan.

As is described in greater detail below, the present invention alleviates such problems associated with prior art blade assemblies. The present invention provides the benefits of a more efficient blade assembly and added rigidity of the blades by having a vane component located at an optimal position between the central hub and the distal ends of the blades.

SUMMARY OF THE INVENTION

It is an object of the present invention to provide a fan blade assembly having a plurality of blades arranged about a central hub with an axis of rotation, projecting from the hub radially outward from the axis of rotation. Each blade has a blade length with a proximal end attached to the central hub and a distal end radially outward from the central hub, and a vane member having a plurality of vane segments. Each vane segment joins a first blade with an adjacent second blade at a place along the blade length radially inward from the distal end and radially outward from the proximal end of each said first and second blades.

It is another object of the present invention to provide a motor-driven fan blade assembly having a central hub with a central axis of rotation and a plurality of fan blades generally evenly-spaced about the hub and extending radially outward from the hub. Each blade has a blade length with a proximal end integrally connected to the central hub, and a distal end radially outward from the central hub, to define a circumferential blade area of the blade assembly. Each of the plurality of blades is adapted to receive an air pressure axial load along the length of the blade during rotation of the blade assembly, which propels air in a direction generally transverse to the circumferential blade area. The blade assembly has a vane member with a plurality of vane segments, each vane segment joining a first blade with an adjacent second blade at a vane area located between the distal end and the proximal end of each first and second blade. It is a further object of the present invention to provide a fan blade assembly with a plurality of primary blades and circumferential vane members, and to also provide a fan blade assembly having a plurality of secondary fan blades extending radially outward from a first vane member.

It is another object of the present invention to provide a fan blade assembly which is adapted to readily stack with like assemblies for shipment and storage by providing a plurality of recesses in the hub which receive front edge portions of proximal ends of blades, thereby permitting interfitting of the central hubs of adjacent blade assemblies.

Other advantages and aspects of the present invention will become apparent upon reading the following description of the drawings and detailed description of the invention.

DETAILED DESCRIPTION OF THE PREFERRED EMBODIMENT

Figure 1:
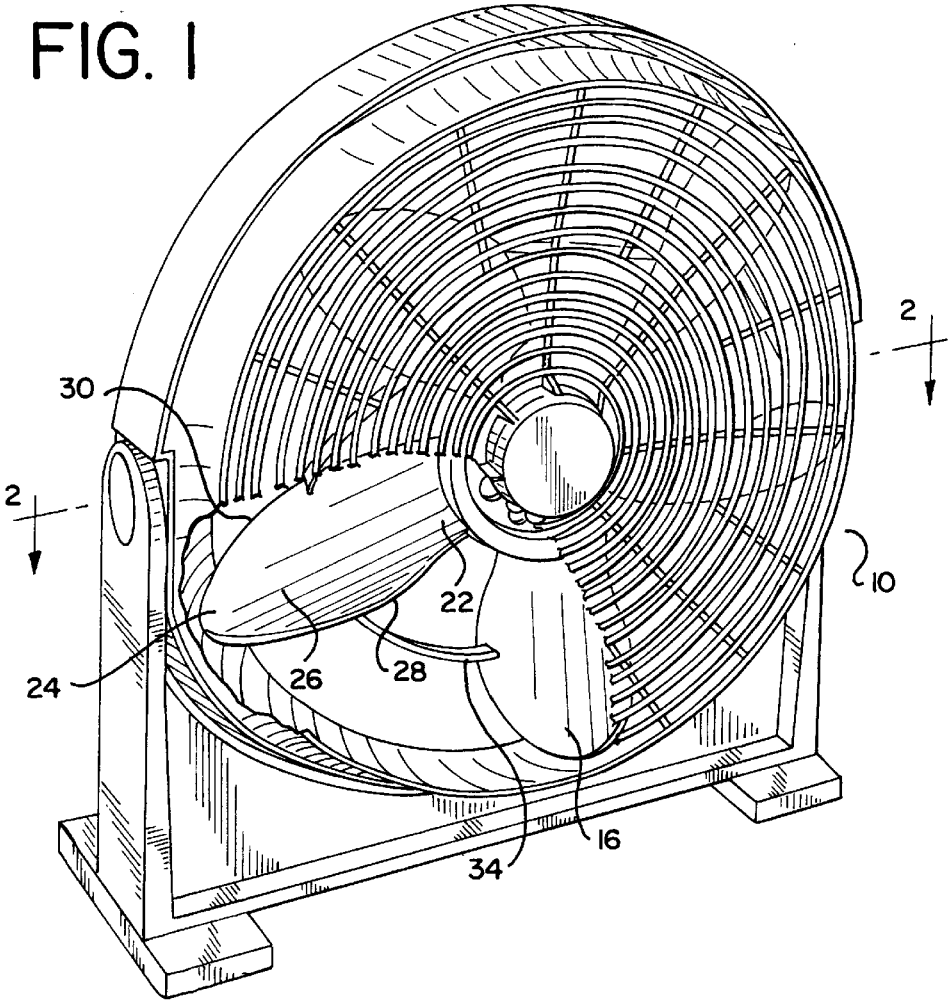
FIG. 1 is an elevated perspective view of a fan having a portion of the front cut away to show a fan blade assembly according to the present invention.

While this invention is susceptible of embodiment in many different forms, there is shown in the drawings and will herein be described in detail a preferred embodiment of the invention with the understanding that the present disclosure is to be considered as an exemplification of the principles of the invention, and is not intended to limit the broad aspect of the invention to the embodiments illustrated.

The present invention relates to an improved propeller-type blade assembly, preferably for use with a motor driven air circulator, such as a window fan. In the preferred embodiment, the fan 10 is an electricpowered air circulator driven by an electric motor 12 to drive a fan blade assembly 14. The blade assembly 14 includes a plurality of blades 16 arranged about a central hub 18, the center of the hub 18 being aligned with the central axis of rotation A—A of the propelled blade assembly 14. The blades 16 are integrally connected to an outer surface 20 of the side wall 58 of the hub 18 and project radially outward from the central axis of rotation A—A of the assembly 14.

The central hub 18 has a front wall 56 integral with a side wall 58 with a rear edge 60 which is generally concentric with the central axis of rotation. The hub rear wall 60 preferably has at least one recess 62, and preferably a plurality of such recesses 62, approaching the front wall 56. The rear edge 60 defines an open end 64 of the hub 18 which is adapted to receive a front portion of the hub of an adjacent-like blade assembly, receiving at least the front wall 56 of such an adjacent assembly within the open end 64. Each recess 62 in the hub 18 is adapted to receive at least a portion of the leading edge 28 of the proximal end 22 of a blade 16 of such an adjacent assembly, thereby permitting interfitting stacking of like blade assemblies.

Figure 2:
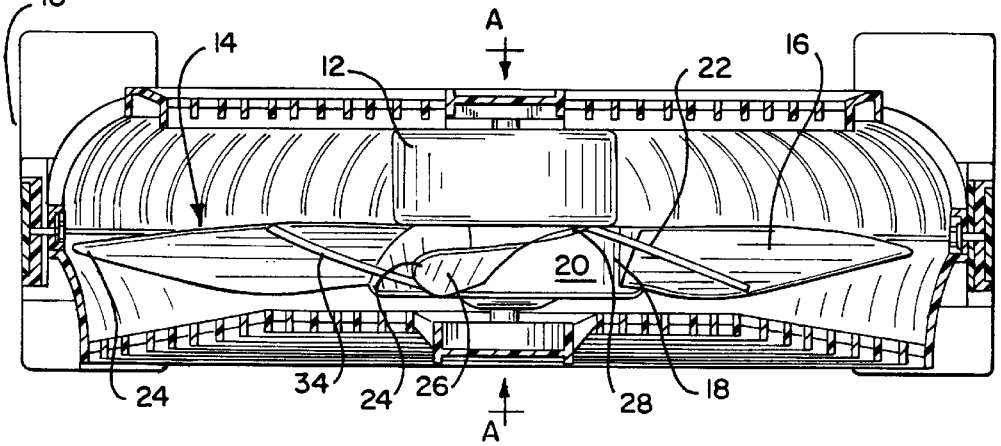
FIG. 2 is a cross-sectional view along 2—2 of FIG. 1.
Figure 3:
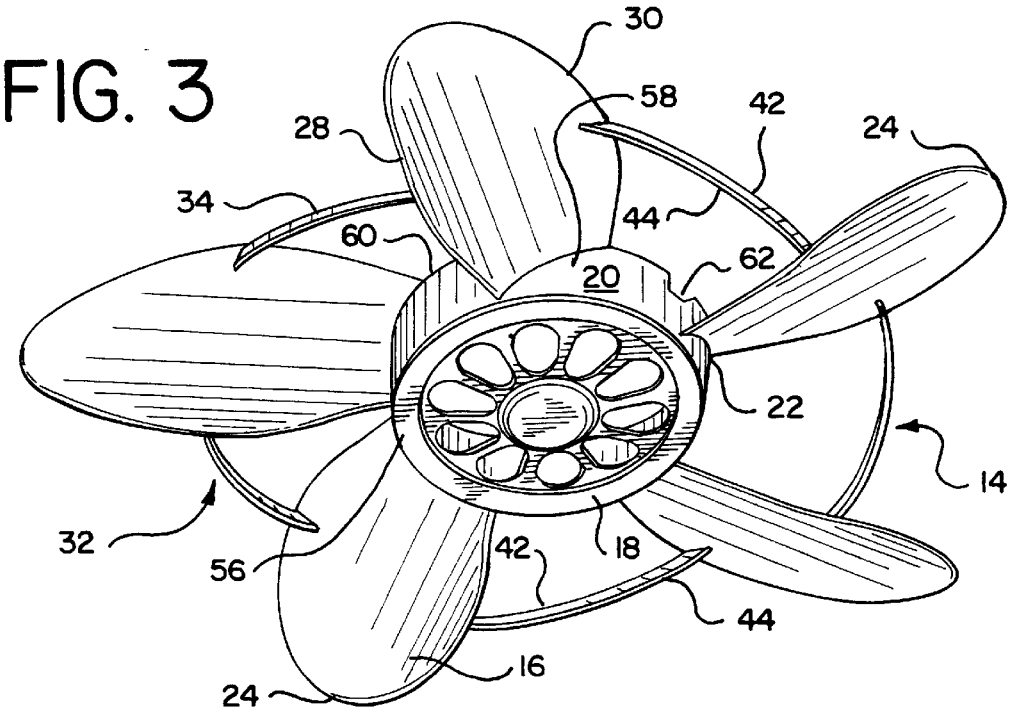
FIG. 3 is a perspective view of a fan blade assembly according to the present invention.
Figure 4:
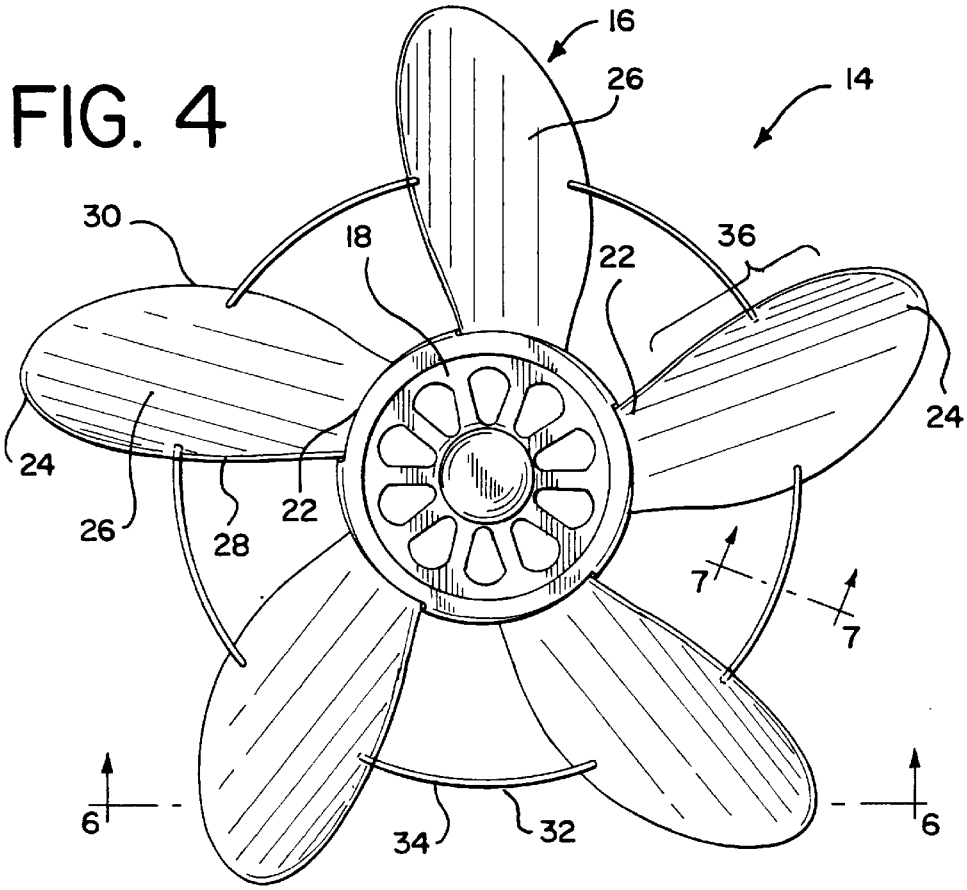
FIG. 4 is a front view of the blade assembly shown in FIG. 3.
Figure 5:
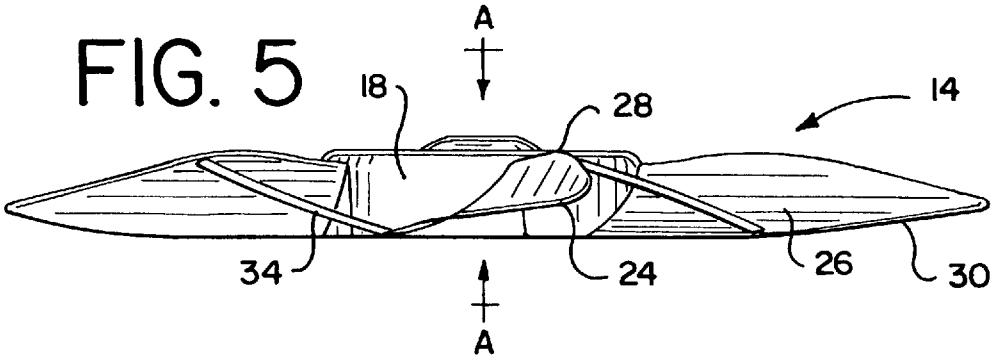
FIG. 5 is a side view of the blade assembly shown in FIG. 3.
Figure 6:
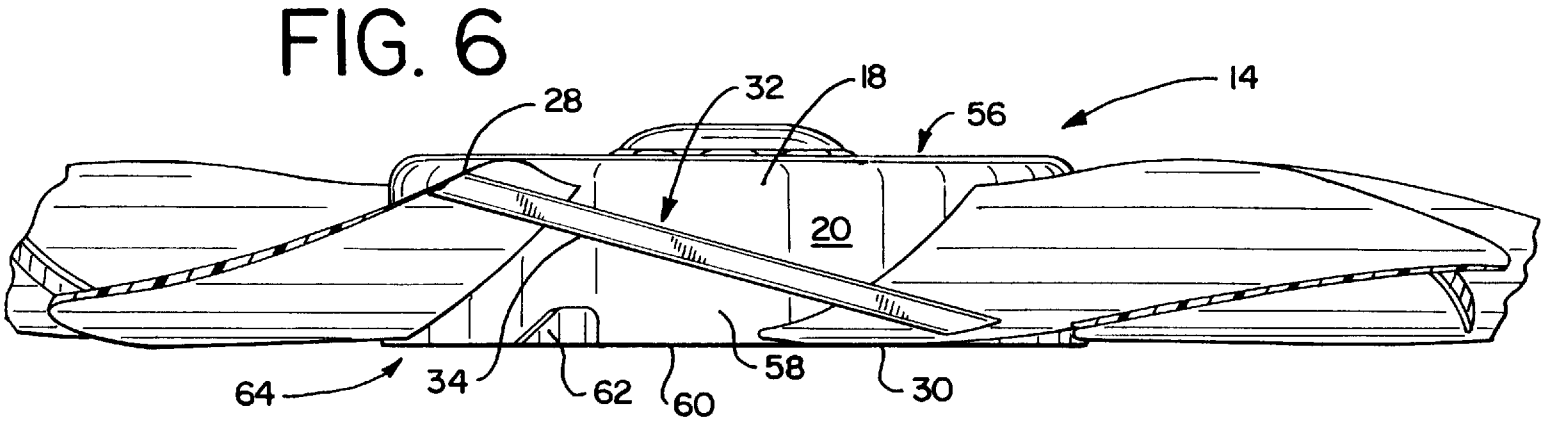
FIG. 6 is a partial cross-sectional view along 6—6 of FIG. 4.
Figure 7:
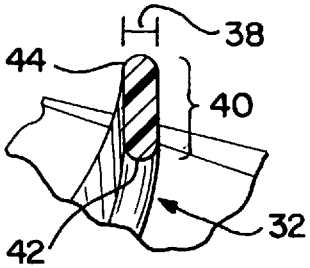
FIG. 7 is a partial cross-sectional view along 7—7 of FIG. 4.
Figure 8:
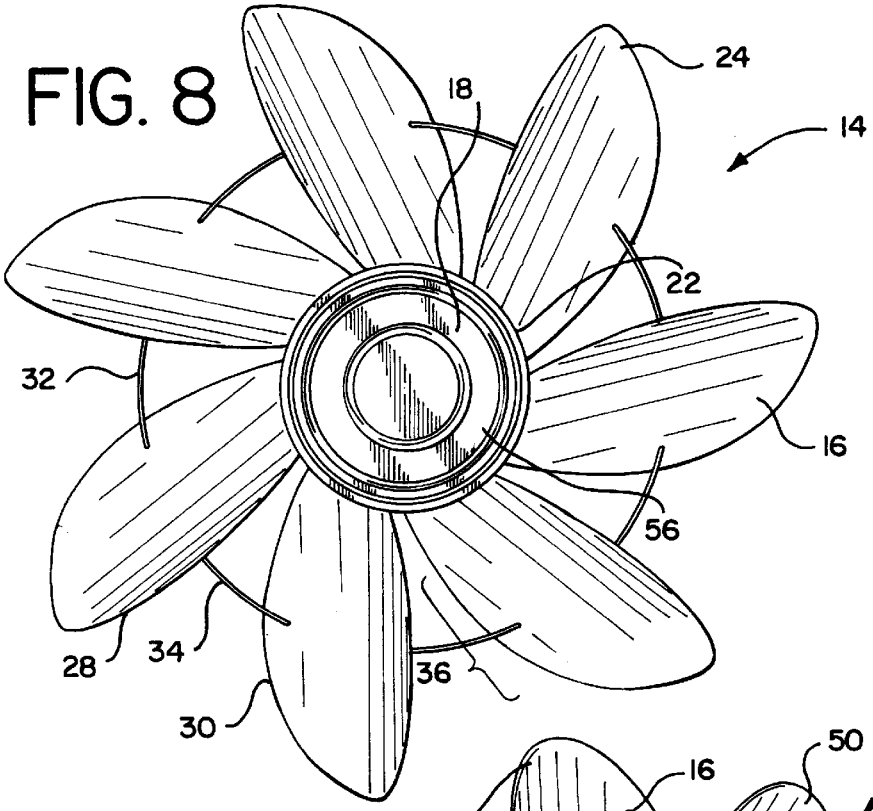
FIG. 8 is a front view of a blade assembly of the invention in an alternative embodiment from the blade assembly of FIG. 4.

Each blade 16 has a proximal end 22 adjacent the hub 18, and a distal end 24 radially outward from the hub 18. Each blade 16 has an elongated body 26 between the proximal end 22 and the distal end 24. Each blade 16 has a leading edge 28 and a trailing edge 30. Preferably, the blade body 26 is designed to have a curvature between the leading edge 28 and the trailing edge 30, and has a twist or wane shape between the proximal end 22 and the distal end 24 (FIG. 2). This preferred blade design provides an enhanced propelling force of air when the blade assembly 14 is rotated during operation. The curvature of the blade 16 provides increased lift coefficient, and the slope of the angular orientation of the blade 16 provides optimal desired propeller force.

A vane 32 comprised of a plurality of vane segments 34 joins the blades 16 of the blade assembly 14. Preferably, each vane segment 34 joins one blade to an adjacent blade by being secured at or near the leading edge 28 of the first blade to at or near the trailing edge 30 of the adjacent blade. The vane segments 34 are preferably arcuate in length, such that the vane segments 34 collectively form a vane 32 which follows a generally circular path concentric with the central axis of rotation A—A.

The vane segments 34 preferably each have a desired pitch when viewed in cross section across its width 40, such that the rear edge 42 of the vane 32 is closer to the axis of rotation A—A than the front edge 44 of the vane 32. This cross-sectional pitch of the vane 32 provides increased efficiency of the fan blade assembly by drawing more air toward the central and proximal end of the blades.

In operation, rotation of the blade assembly 14 is rapid, such that the vane segments 34 appear as a solid and continuous vane structure by the oscillating vane, thereby creating an oscillating vane width. The vane 32 is located radially outward from the proximal end 22 of the blades, preferably at an approximate middle point along the length of the blades 16 between the proximal end 22 and the distal ends 24. More specifically, the vane is preferably located at a point along the blade lengths, which provides the optimal benefit of structural support of the vane segments 34 between adjacent blade members 16 and the formation of a vane 32 structural barrier, when the blade assembly 14 is rotated rapidly, without compromising the balance of efficient weight distribution of the blade assembly 14. Further, the vane 32 is a structural component, during rotation of the blade, which provides increased efficiency by directing air into a laminar flow pattern toward the front of the blade, rather than in an outward air flow pattern toward the distal ends of the blades. In operation, therefore, the blade assembly 14 includes balanced rotation of the vane segments 34 forming a rotating vane 32, which draws the air toward a laminar flow and serves to contain the air toward the inner area of the rotating blade, adjacent the central axis of rotation A—A. The result is increased efficiency of the air circulation by reduction of turbulent air flow and containing the air flow within the more effective area of the blade assembly 14, namely, the region of the blade body 26 adjacent the proximal end 22 of the blades 16.

The structural support of the vane segments 34 between adjacent blades further provides a vane structure 32 which strengthens and supports the rigidity of the blades 16, thereby reducing the torsional vibration of the blades 16. Reduction in the torsional vibration of the blades 16, believed to be a torsional vibration unavoidably caused by turbulent air pressure acting on the blades 16, provides a much higher resonance frequency of the blade vibration, thereby reducing fan blade noise. Because of such beneficial aspects of the vane structure 32 during operation of the fan, the blades 16 may be made of thinner material.

With regard to the location of the vane 32 along the length of the blade body 26, it is believed that the optimal point of the vane location on the blades 16 is between 55%–70% of the blade length from the proximal end 22. In operation, rotation of the blades 16 results in an air pressure axial load along the blade length to propel air in a direction generally transverse to the rotating circumferential area of the blade assembly 14. The blade 16 is preferably designed with an angular surface in cross-section, the angular slope being incremental along the blade length to provide a localization of the air pressure load to a transition region 36. The vane 32 is located within this transition region 36, preferably at or near the outer circumferential region of the transition area. More specifically, the blade assembly 14 is designed to have a transition region 36 with an area of peak axial load, and the vane 32 is located at or near that peak axial load area. This is further described in the following example.

EXAMPLE

The fan blade assembly 14 has five blade fins 16 equally spaced along the outer surface 20 of the hub 18. The blades 16 have an arcuate curvature in cross section, which provides a desired lift coefficient to force air to a laminar flow outwardly, generally transverse to the circumferential blade area comprised of the length of the body 26 of the blades 16. Rotation of the blades thereby causes an axial air pressure on each blade along at least a portion of the blade length, defined as a transition area. The axial air pressure load is the greatest in a given region of the transition area, an area identified as the peak air pressure load region at a location approximately 65%–70% of the length of the blade 16 from the proximal end 22. The vane 32 is preferably located within the transition area 36, adjacent to and inward from the peak air pressure load region. In this example, the vane 32 is located at approximately 50% of the length of the blades 16 from the proximal end 22 of each blade.

The vane segments 34 are integrally attached to one blade to join with an adjacent blade. The optimal supporting strength of the vane is provided by the vane segments 34 each being integrally attached to a region of the leading edge 28 of the blade and a region of the trailing edge 30 of an adjacent blade. The vane segments 34 preferably have a thickness 38 and a width 40. The thickness 38 and width 40 of the vane segments 34 provide rigidity to the vane. Further, the width of the vane extends to the upper surface 42 of the first blade, beyond the leading edge 28, and extends to the lower surface 44 of the adjacent blade, beyond the trailing edge 30.

The vane 32 of the blade assembly 14 of this example provides added rigidity to the blade assembly to permit at least a 15% reduction in the material thickness of the blades when made of molded plastic, while enhancing laminar outward air flow by the fan operation. Further, because the vane 32 adds a structural bridge between adjacent fan blades 16, the molding process of manufacturing the blade assembly is made more efficient, since the blade assembly 14 may be removed from the mold while still in the cooling process without the concern of substantial distortion of the blades. Also, when the blade assembly is constructed of plastic, such as polypropylene, a material which has a tendency to shrink when cooling after a molding process, the vane structure prevents reduction of the amount of warpage of the blades during cooling. With the present example, the warping of the blade made of polypropylene according to the prior art practice is approximately ¼" at the approximate mid-point along the blade length. The blade assembly made of polypropylene and having a vane structure, as described above, however, resulted in the warping of only less than 1/16" at the mid-length of the blade.

Figure 9:
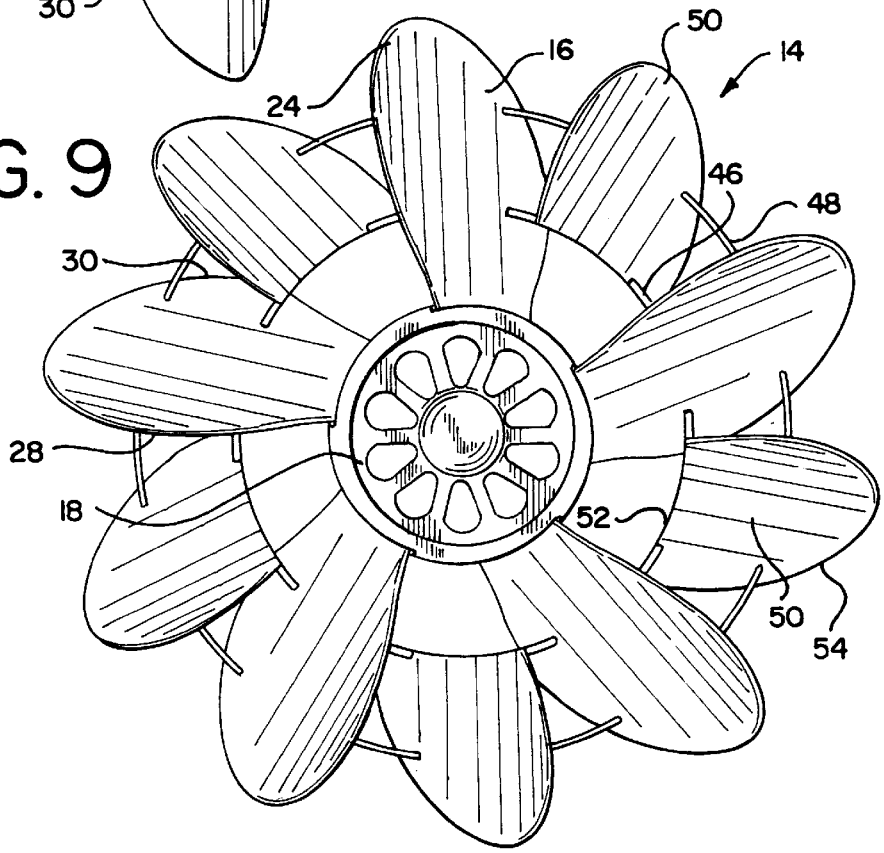
FIG. 9 is a front view of an alternative embodiment wherein the blade assembly has a plurality of vanes and secondary blades.

In an alternative embodiment (FIG. 9), the blade assembly has a plurality of vanes 46, 48, each formed of vane segments 34 between blades 16. For example, to increase the rigidity of the blades and thereby reduce the torsional vibration, the blade assembly may include a plurality of vanes, a first vane 46 located approximately one-third the length of the blade from the proximal end, and a second vane 48 located approximately two-thirds the length of the blade. Such plurality of vanes provides enhanced concentration of the air in the transition area for increased airflow, while further reducing the torsional vibration on the blade for more quiet fan operation.

As another alternative embodiment, the blade assembly includes secondary blades 50, such as "half-wing" blade segments secured to the vane segments. Preferably, such wing segments would be positioned in the transition area of the blade assembly to provide increased torque of airflow. For example, in the embodiment described above wherein the blade assembly includes a first vane 46 and a second vane 48, secondary blades 50 are included as blade segments positioned between the full primary blades 16 and passing between the first and second vane 46, 48. In this embodiment, therefore, the blade assembly may have a small number of full blades 16, such as three, four or five blades, and have at least an equal number of secondary blades 50. The secondary blades each have a first end portion 52 attached to adjacent blades 16 by the first vane 46, and a second end portion 54 attached to adjacent primary blades 16 by the second vane 48. In this example, the secondary blades 50 provide an airflow increase, estimated at approximately 40% increase, while the torque requirements for the fan is significantly lower, estimated at approximately 30% requirement increase. This embodiment is believed to be beneficial primarily because the secondary blades 50 are positioned in the transition area (the region of the greatest axial air pressure load), although the secondary blade has less mass and uses less material than a full blade. In operation, the secondary blades between the larger primary blades reduce the air turbulence and increase the efficiency of the blade assembly directing air to laminar flow, especially in the outer region of the blades near the distal ends 24. Further, the first and second vanes 46, 48, help to reduce the amount of airflow toward the distal end 24 of the blades, and provide added strength of the blade assembly. Although not shown separately in the Figures, the blade assembly may also have secondary blades 50 with only one vane 32, such is described above, by securely joining the secondary blades to adjacent primary blades 16 by the single vane member, without the need for a second vane member.

While the specific embodiments have been illustrated and described, numerous modifications come to mind without significantly departing from the spirit of the invention and the scope of protection is only limited by the scope of the accompanying claims.

What we claim is:

1. A fan blade assembly, comprising:

a plurality of blades arranged about a central hub having an axis of rotation, the blades projecting from the hub radially outward from the axis of rotation;

each blade having a blade length with a proximal end attached to the central hub and a distal end radially outward from the central hub;

a vane member having a plurality of vane segments, each vane segment joining a first blade with an adjacent second blade at a place along the blade length located radially inward from the distal end and radially outward from the proximal end of each said first and second blades; and, each blade having a blade width with a leading edge area and a trailing edge area, each of the plurality of vane segments joining at least the leading edge area of a blade to at least the trailing edge area of an adjacent blade.

2. The fan blade assembly of claim 1, wherein the vane member is generally concentric with the axis of rotation.

3. The fan blade assembly of claim 1, wherein the vane member is located at approximately the middle point of the length of the blade between the proximal and the distal ends of the blade.

4. The fan blade assembly of claim 1, wherein each fan blade having a front surface and a rear surface, each plurality of vane segments joining the front surface of a blade to the rear surface of an adjacent blade.

5. The fan blade assembly of claim 1, wherein the vane segments have a front edge and a rear edge, the rear edge being at least slightly closer to the axis of rotation than the front edge.

6. The fan blade assembly of claim 1, wherein the central hub having a side wall with a front edge and a rear edge generally concentric with the central axis of rotation, and an open end, the rear edge having a plurality of recesses each adapted to receive the leading edge of the proximal blade end of an adjacent blade assembly when the front edge of the hub of said adjacent assembly is received into the hub open end for stacking blade assemblies in interfitting arrangement.

7. A fan assembly, comprising:

a motor-driven fan blade assembly having a central hub with a central axis of rotation;

a plurality of fan blades generally evenly-spaced about the hub and extending radially outward from the hub;

each blade having a blade length with a proximal end integrally connected to the central hub and a distal end radially outward from the central hub to define a circumferential blade area of the blade assembly, each of the plurality of blades adapted to receive an air pressure axial load along the length of the blade during rotation of the blade assembly to propel air in a direction generally transverse to the circumferential blade area;

a vane member having a plurality of vane segments, each vane segment joining a first blade with an adjacent second blade at a vane area, the vane area being located between the distal end and the proximal end of each said first and second blade; and, each blade having a leading edge area and a trailing edge area, each of the plurality of vane segments joining at least the leading edge area of a blade to at least the trailing edge area of an adjacent blade.

8. The fan blade assembly of claim 7, wherein:

each blade having a leading edge and a trailing edge separated by a blade body;

the blade body having a varying width along the length of the blade, and having an angular surface relative to the axis of rotation, the angular surface having an incremental slope along the length of the blade, the varying width and incremental slope of the blade body being adapted to localize said axial air pressure load on the blade to within a transition region of the circumferential blade area between the distal and proximal ends; and the vane area being located within the transition region of the blade length.

9. The fan blade assembly of claim 8, wherein each fan blade having an arcuate width in cross section in the transition area.

10. The fan blade assembly of claim 7, wherein the vane area is located at approximately the middle point of the blade length between the proximal and the distal ends of the blades.

11. The fan blade assembly of claim 8, wherein the vane area is located between the proximal end of the blade and a peak axial air pressure load area of the transition region.

12. The fan blade assembly of claim 11, wherein the vane area is located at approximately the middle point of the blade length between said proximal and distal ends, and the peak axial load area is located at a point approximately 65–70% of the length of the blade from the proximal end.

13. The fan blade assembly of claim 9, wherein each fan blade having a front surface and a rear surface, each of the plurality of vane segments joining the front surface of one blade to the rear surface of an adjacent blade.

14. The fan blade assembly of claim 9, wherein the vane has a front edge and a rear edge, at least one vane segment having an angular pitch such that the rear edge is closer to the axis of rotation than the front edge.

15. The fan blade assembly of claim 9, wherein:

each blade having a leading edge and a trailing edge separated by a blade body;

the central hub having a side wall with a front edge and a rear edge generally concentric with the central axis of rotation, and an open end, the rear edge having a plurality of recesses each adapted to receive the leading edge of the proximal blade end of an adjacent blade assembly when the front edge of the hub of said adjacent assembly is received into the hub open end for stacking blade assemblies in interfitting arrangement.

16. The fan blade assembly of claims 1 or 7, further comprising at least one secondary fan blade joined by the vane member between the first and adjacent blades, at least a portion of the secondary blade extending radially outwardly from the vane member.

17. The fan blade assembly of claims 1 or 7, further comprising a second vane member having a plurality of second vane member segments, each said second vane segment joining a blade to an adjacent blade.

18. A fan blade assembly, comprising:

a plurality of primary blades arranged about a central hub having an axis of rotation, each primary blade having a blade length with a proximal end attached to the central hub and a distal end radially outward from the central hub, each blade having a leading edge and a trailing edge;

a plurality of secondary blades, each secondary blade having a first end portion located radially outward from the hub and a second end portion; and a first circumferential vane member having a plurality of vane segments, each vane segment joining a primary blade with the first end portion of an adjacent secondary blade.

19. The fan blade assembly of claim 18, further comprising a second vane member radially outward of the first vane member, the second vane member joining at least one secondary blade to an adjacent primary blade at a location radially inward from the distal end of the primary blade.

20. The fan blade assembly of claim 18, wherein:

the central hub having a side wall with a front edge and a rear edge generally concentric with the central axis of rotation, and an open end, the rear edge having a plurality of recesses each adapted to receive the leading edge of the proximal end of a primary blade of an adjacent blade assembly when the front edge of the hub of said adjacent assembly is received into the hub open end for stacking blade assemblies in interfitting arrangement.

* * * * *